US012504219B2

(12) United States Patent
Huang et al.

(10) Patent No.: US 12,504,219 B2
(45) Date of Patent: Dec. 23, 2025

(54) STORAGE BOX AND REFRIGERATOR

(71) Applicant: Gree Electric Appliances, Inc. of Zhuhai, Guangdong (CN)

(72) Inventors: Shanshan Huang, Guangdong (CN); Aoxiang Zhang, Guangdong (CN); Jizong Liu, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 160 days.

(21) Appl. No.: 18/688,584

(22) PCT Filed: Jul. 26, 2022

(86) PCT No.: PCT/CN2022/107778
§ 371 (c)(1),
(2) Date: Mar. 1, 2024

(87) PCT Pub. No.: WO2023/098108
PCT Pub. Date: Jun. 8, 2023

(65) Prior Publication Data

US 2025/0123051 A1 Apr. 17, 2025

(30) Foreign Application Priority Data

Dec. 1, 2021 (CN) ..... 202111453611.8

(51) Int. Cl.
*F25D 23/02* (2006.01)

(52) U.S. Cl.
CPC ..... *F25D 23/028* (2013.01); *F25D 2323/02* (2013.01); *F25D 2323/024* (2013.01)

(58) Field of Classification Search
CPC ..... F25D 23/02; F25D 23/025; F25D 23/028; F25D 2323/02; F25D 2323/024
See application file for complete search history.

(56) References Cited

U.S. PATENT DOCUMENTS 3,810,275 A * 5/1974 Smith ..... E05F 1/1215 16/306
2002/0124738 A1* 9/2002 Lee ..... A23B 2/001 99/473

(Continued)

FOREIGN PATENT DOCUMENTS

CN 104295176 A 1/2015
CN 102564042 B 12/2016

(Continued)

OTHER PUBLICATIONS

EP 22899928, Extended European Search Report, Jan. 30, 2025.

(Continued)

*Primary Examiner* — Joseph F Trpisovsky
(74) *Attorney, Agent, or Firm* — The Webb Law Firm

(57) ABSTRACT

A storage box and a refrigerator are provided. The storage box includes an item container comprising a box body; a container lid comprising a lid body and a connecting rod fixedly connected to the lid body and hinged to the box body; and a first container lid connecting mechanism, comprising an elastic telescopic mechanism and/or a rotary push mechanism. The elastic telescopic mechanism includes a first telescopic rod hinged to the connecting rod and the box body and an elastic member tending to lengthen the first telescopic rod. The rotary push mechanism includes a rotating member rotatably connected to the box body and non-rotationally connected to the connecting rod, and a translating member disposed outside the box body in a translatable manner with respect to the box body. The translating member is configured to translate by rotational movement of the rotating member or to rotate the rotating member.

15 Claims, 7 Drawing Sheets

(56) References Cited

U.S. PATENT DOCUMENTS

| | | | | |
|---|---|---|---|---|
| 2013/0264930 | A1 | 10/2013 | Kim et al. | |
| 2013/0342095 | A1 | 12/2013 | Choo et al. | |
| 2020/0024878 | A1* | 1/2020 | Kim | E05F 1/105 |

FOREIGN PATENT DOCUMENTS

| | | | |
|---|---|---|---|
| CN | 106839566 | A | 6/2017 |
| CN | 209399645 | U | 9/2019 |
| CN | 114001519 | A | 2/2022 |
| CN | 216308354 | U | 4/2022 |
| JP | 2009052802 | A | 3/2009 |
| JP | 2015190692 | A | 11/2015 |
| WO | 9943998 | A1 | 9/1999 |

OTHER PUBLICATIONS

CN 202111453611.8, First Office Action, Aug. 26, 2023.
CN 202111453611.8, First Office Action Search Report, Aug. 26, 2023.
PCT/CN2022/107778, International Search Report, Oct. 17, 2022.

* cited by examiner

STORAGE BOX AND REFRIGERATOR

CROSS-REFERENCE TO RELATED APPLICATIONS

This application is the United States national phase of International Patent Application No. PCT/CN2022/107778, filed Jul. 26, 2022, and claims priority to Chinese Patent Application No. 202111453611.8, filed Dec. 1, 2021, the disclosures of which are hereby incorporated by reference in their entireties.

BACKGROUND OF THE INVENTION

Field of the Invention

The present disclosure relates to the field of item storage technology, in particular to a storage box and a refrigerator.

Description of Related Art

With the improvement of people's living standards, consumers have higher requirements on the functional diversity of a refrigerator, and refining of storage area division. To meet users' requirements on low-temperature storage of tea, cosmetics, medicines and other private items, and to avoid items with strong odor from tainting food in the refrigerator, the existing refrigerator is generally provided with a storage box. A storage box is a detachable accessory on a refrigerator, and a lid body of the storage box usually needs to be closed manually and often needs to be manually maintained in an open state, which is poor user experience.

SUMMARY OF THE INVENTION

An object of the present disclosure is to provide a storage box and a refrigerator, aiming to solve the problem of poor user experience of a storage box in the related art.

In a first aspect of the present disclosure, there is provided a storage box, including:

an item container including a box body, the box body having a box body opening;

a container lid including a lid body and a connecting rod fixedly connected to the lid body, the connecting rod being hinged to the box body, the lid body being hinged with the box body by the connecting rod, and being configured to open and close the box body opening; and a first container lid connecting mechanism including an elastic telescopic mechanism and/or a rotary push mechanism, wherein the elastic telescopic mechanism includes a first telescopic rod and an elastic member, one end of the first telescopic rod being hinged to the connecting rod, and the other end of the first telescopic rod being hinged to the box body, and the elastic member applying to the first telescopic rod a force that tends to lengthen the first telescopic rod; and the rotary push mechanism includes a rotating member and a translating member, the rotating member being rotatably connected to the box body, and non-rotationally connected to the connecting rod, a rotation axis of the rotating member being coaxial with a hinge axis of the connecting rod and the box body, and the translating member being disposed outside the box body in a translatable manner with respect to the box body, and being configured to translate by means of rotational movement of the rotating member or to rotate the rotating member by translational movement of the translating member.

In the storage box of some embodiments, the first telescopic rod includes:

a sleeve including a sleeve hinge portion and a sleeve hollow portion, the sleeve hinge portion being provided at one end of the sleeve, and the sleeve hollow portion being provided along an axial direction of the sleeve and having a sleeve opening at the other end of the sleeve; and a movable rod, one end of the movable rod extending from the sleeve opening into the sleeve hollow portion and being movable along the axial direction of the sleeve, and the other end of the movable rod being provided with a movable rod hinge portion, the sleeve hinge portion and the movable rod hinge portion being respectively located at two ends of the first telescopic rod, and being respectively hinged to the box body and the connecting rod.

In the storage box of some embodiments, the elastic member includes a compression spring sleeved on the first telescopic rod.

In the storage box of some embodiments, the rotating member includes a push rod, one end of the push rod being rotatably connected to the box body, and being non-rotationally connected to the connecting rod, and the other end of the push rod being provided with a projection disposed in a radial direction of the push rod; and the translating member includes a rotary cap, which is sleeved on the end of the push rod provided with the projection and has a helical groove cooperating with the projection.

In the storage box of some embodiments, the push rod is non-rotationally connected to the connecting rod by shape engagement.

In the storage box of some embodiments, the first container lid connecting mechanism includes a limiting structure, the limiting structure including:

a first limiting structure configured to restrict a limit position of the translating member translating relative to the box body; and/or a second limiting structure configured to restrict rotation of the translating member relative to the box body; and/or a third limiting structure configured to restrict motion of the translating member relative to the box body in a direction perpendicular to a translation direction of the translating member.

In the storage box of some embodiments, the first limiting structure includes a first translation limiting surface and a second translation limiting surface, the first translation limiting surface being fixedly disposed relative to the box body, with a spacing being formed from the box body, the second translation limiting surface being disposed on the translating member, and the second translation limiting surface being located in the spacing between the first translation limiting surface and the box body; and/or the second limiting structure includes a first rotation-limiting portion and a second rotation-limiting portion, the first rotation-limiting portion being fixedly disposed relative to the box body, and the second rotation-limiting portion being disposed on the translating member, the first rotation-limiting portion being in form fit with the second rotation-limiting portion to restrict rotation of the translating member with respect to the box body; and/or the third limiting structure includes a limiting hole, and the translating member is located in the limiting hole, the limiting hole having a large end and a small end, and the limiting hole smoothly transiting from the large end to the small end along the translation direction of the translating member, the large end being farther from the box body than the small end.

In the storage box of some embodiments, the box body is provided with a first accommodating slot, and the first container lid connecting mechanism further includes a first slot cover, the first slot cover cooperating with the first accommodating slot to form a first accommodating space, the elastic telescopic mechanism being located within the first accommodating space, and at least a portion of the translating member extending out of the first slot cover.

In the storage box of some embodiments, the container lid includes two connecting rods, the two connecting rods being respectively disposed symmetrically at two ends of the container lid, and the storage box includes two first container lid connecting mechanisms, the two first container lid connecting mechanisms being respectively mounted on two opposite side faces of the box body and being respectively connected to the two connecting rods.

In the storage box of some embodiments, the container lid includes two connecting rods, the two connecting rods being respectively disposed symmetrically at two ends of the container lid, and the storage box further includes a second container lid connecting mechanism, the first container lid connecting mechanism and the second container lid connecting mechanism being mounted on two opposite side faces of the box body, one of the two connecting rods being connected to the first container lid connecting mechanism, and the other being connected to the second container lid connecting mechanism, the connecting rod connected to the second container lid connecting mechanism being hinged to the box body, the second container lid connecting mechanism including a second telescopic rod, the second telescopic rod and the first telescopic rod being disposed symmetrically, one end of the second telescopic rod being hinged to the corresponding connecting rod, and the other end of the second telescopic rod being hinged to the box body.

In the storage box of some embodiments, the box body is provided with a second accommodating slot, and the second container lid connecting mechanism further includes a second slot cover, the second slot cover cooperating with the second accommodating slot to form a second accommodating space, the second telescopic rod being located within the second accommodating space.

In the storage box of some embodiments, the item container further includes a snap-fit structure disposed on the box body, the snap-fit structure being configured to fix the storage box.

In the storage box of some embodiments, the storage box further includes a sealing structure, which is provided on the box body and/or the lid body and is configured to seal a gap between the lid body and the item container when the lid body closes the box body opening.

In a second aspect of the present disclosure, there is provided a refrigerator, including:

a body;

a door; and a storage box mounted on the door, the storage box being a storage box of the first aspect of the present disclosure.

In the refrigerator of some embodiments, the storage box is configured such that with closing of the door, the translating member of the storage box translates towards a side of getting closer to a box body of the storage box and causes the rotating member to rotate to close a lid body.

Based on the storage box provided in the present disclosure, the container lid of the storage box is elastically movable. The item container and the container lid of the storage box are connected by a first container lid connecting mechanism. The first container lid connecting mechanism includes an elastic telescopic mechanism and/or a rotary push mechanism. The elastic telescopic mechanism may provide an elastic force for the lid body of the storage box to be kept in a tend-to-be-closed state when being closed, so that the lid body of the container lid is better fit to the item container; may provide an elastic force for the lid body to open automatically after being opened at a certain angle, so that semiautomatic opening/closing of the storage box may be achieved; and may provide an elastic force that supports the lid body in a completely open position when being fully opened, without the need of artificially supporting the lid body by a user. By providing the rotary push mechanism, when the lid body of the storage box is in an open state, the lid body may be manipulated by operating the translating member.

When the storage box is disposed on the door of the refrigerator, the position of the translating member is appropriately set so that the translating member may be pushed to move by means of a force that closes the refrigerator door, thereby implementing automatic closing of the lid body by closing the door of the refrigerator, thus simplifying the operation of the storage box, and preventing taint of odor due to forgetting to close the lid of the storage box, etc.

Other features and advantages of the present disclosure will become apparent from the following detailed description of exemplary embodiments of the present disclosure with reference to the accompanying drawings.

BRIEF DESCRIPTION OF THE DRAWINGS

Drawings illustrated herein are used for providing further understanding of the present disclosure and form part of the present application, and illustrative embodiments of the present disclosure and description thereof are intended for explaining instead of improperly limiting the present disclosure. In the drawings.

DESCRIPTION OF THE INVENTION

Figure 1:
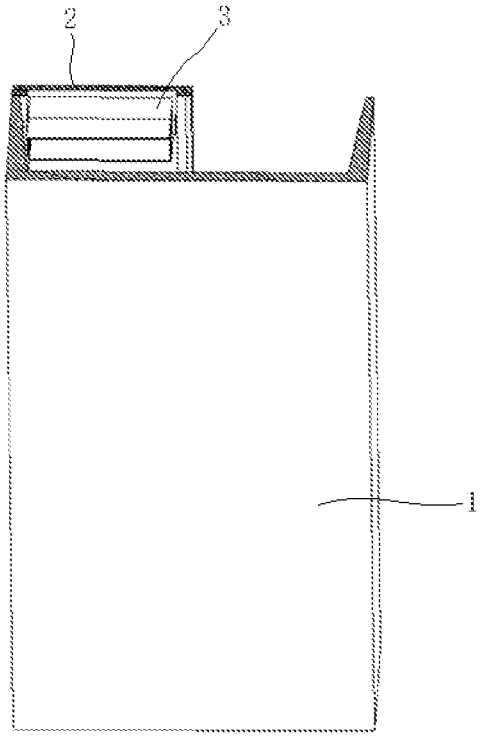
FIG. 1 is a partial structural diagram of a refrigerator and a storage box thereof in embodiments of the present disclosure.

Technical solutions in the embodiments of the present disclosure will be described below clearly and completely in conjunction with the accompanying drawings in the embodiments of the present disclosure. Obviously, the described embodiments are only part of, instead of all of the embodiments of the present disclosure. The following description of at least one exemplary embodiment is actually only illustrative, and in no way serves as any limitation on the present disclosure and its application or use. Based on the embodiments in the present disclosure, all of other embodiments obtained by those of ordinary skill in the art without creative work should fall into the protection scope of the present disclosure.

Unless specifically stated otherwise, the relative arrangement of components and steps, numerical expressions and numerical values set forth in these embodiments do not limit the scope of the present disclosure. Furthermore, it should be appreciated that, for ease of description, the sizes of various parts shown in the drawings are not drawn in accordance with actual proportional relationships. Technologies, methods, and devices known to those of ordinary skill in the related art may be not discussed in detail, but where appropriate, the technologies, methods, and equipment should be regarded as part of the specification as granted. In all examples shown and discussed here, any specific value should be interpreted as merely exemplary, rather than as a limitation. Therefore, other examples of an exemplary embodiment may have different values. It should be noted that similar reference numerals and letters denote similar items in the following drawings, so once a certain item is defined in one drawing, it does not need to be further discussed in subsequent drawings.

In the description of the present disclosure, it should be understood that the use of terms such as "first" and "second" to define parts and components is only for the convenience of distinguishing the corresponding parts and components. Unless otherwise stated, the above terms have no special meanings, and therefore cannot be construed as limitations on the protection scope of the present disclosure.

In description of the present disclosure, it should be understood that orientation or position relations denoted by terms are generally orientation or position relations illustrated based on the drawings, and are merely for the convenience of describing the present disclosure and simplifying description, and unless stated to the contrary, such terms do not indicate or imply the denoted devices or elements must have specific orientations or be constructed and operated in specific orientations, and thus cannot be construed as limiting the protection scope of the present disclosure; and orientation terms "inner" and "outer" refer to the inside and outside with respect to the contour of each component itself.

Figure 2:
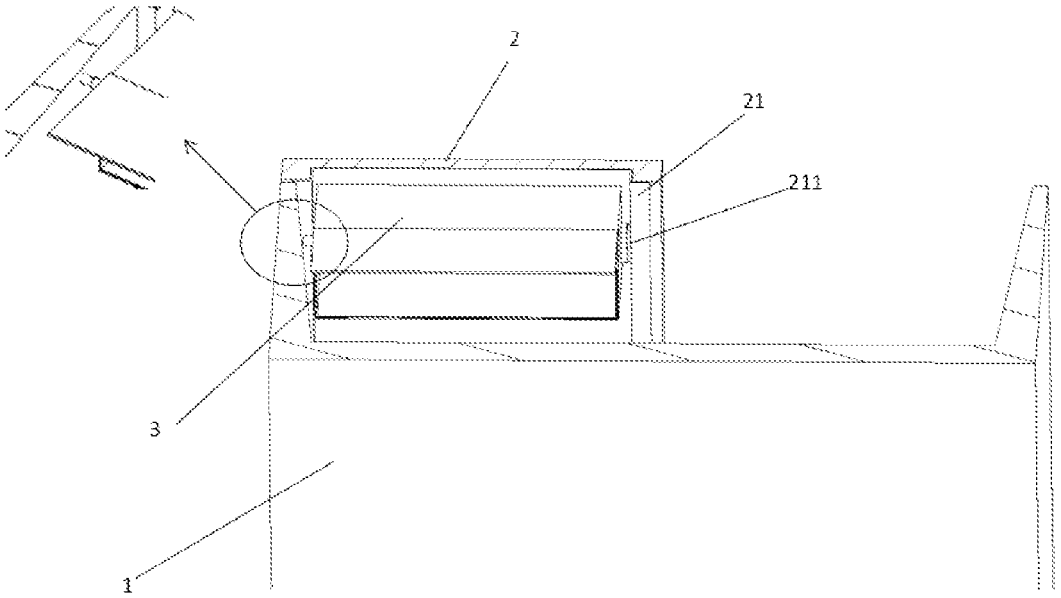
FIG. 2 is a partial structural diagram of a refrigerator and a storage box thereof in embodiments of the present disclosure.

As shown in FIGS. 1 to 15, embodiments of the present disclosure provide a storage box 3 and a refrigerator with the storage box 3. As shown in FIGS. 1 and 2, the refrigerator includes a body 1, a door 2 and a storage box 3 provided on the door 2.

As shown in FIGS. 1 to 15, the storage box 3 mainly includes an item container 4, a container lid 5, and a first container lid connecting mechanism. The item container 4 includes a box body 40. The box body 40 has a box body opening 401. The container lid 5 includes a lid body 50 and a connecting rod 51 fixedly connected to the lid body 50. The connecting rod 51 is hinged to the box body 40. The lid body 50 is hinged with the box body 40 by the connecting rod 51, and is configured to open and close the box body opening 401. The first container lid connecting mechanism includes an elastic telescopic mechanism 6 and/or a rotary push mechanism 7. The elastic telescopic mechanism 6 includes a first telescopic rod and an elastic member. One end of the first telescopic rod is hinged to the connecting rod 51, and the other end of the first telescopic rod is hinged to the box body 40. The elastic member applies to the first telescopic rod a force that tends to lengthen the first telescopic rod. The rotary push mechanism 7 includes a rotating member and a translating member. The rotating member is rotatably connected to the box body 40, and is non-rotationally connected to the connecting rod 51. A rotation axis of the rotating member is coaxial with a hinge axis of the connecting rod 51 and the box body 40. The translating member is disposed outside the box body 40 in a translatable manner with respect to the box body 40, and is configured to translate by means of rotational movement of the rotating member or to rotate the rotating member by translational movement of the translating member.

In the storage box 3 of embodiments of the present disclosure, the container lid 5 of the storage box 3 is elastically movable. The item container 4 and the container lid 5 of the storage box 3 are connected by a first container lid connecting mechanism. The first container lid connecting mechanism includes an elastic telescopic mechanism 6 and/or a rotary push mechanism 7. The elastic telescopic mechanism 6 may provide an elastic force for the lid body 50 of the storage box 3 to be kept in a tend-to-be-closed state when being closed, so that the lid body 50 of the container lid 5 is better fit to the item container 4; may provide an elastic force for the lid body 50 to open automatically after being opened at a certain angle, so that semiautomatic opening/closing of the storage box 3 may be achieved; and may provide an elastic force that supports the lid body 50 in a completely open position when being fully opened, without the need of artificially supporting the lid body 50 by a user. By providing the rotary push mechanism, when the lid body 50 of the storage box 3 is in an open state, the lid body may be manipulated by operating the translating member. When the storage box 3 is disposed on the door of the refrigerator, the position of the translating member is appropriately set so that the translating member may be pushed to move by means of a force that closes the refrigerator door, thereby implementing automatic closing of the lid body 50 by closing the door of the refrigerator, thus simplifying the operation of the storage box 3, and preventing taint of odor due to forgetting to close the lid of the storage box, etc.

Figure 3:
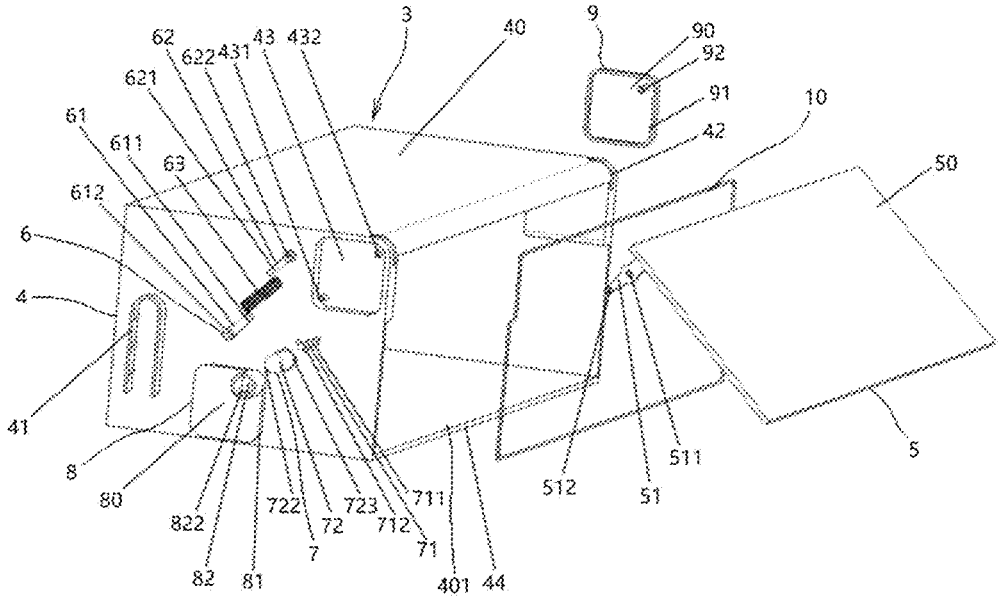
FIG. 3 is an exploded structural diagram of a storage box of embodiments of the present disclosure.
Figure 4:
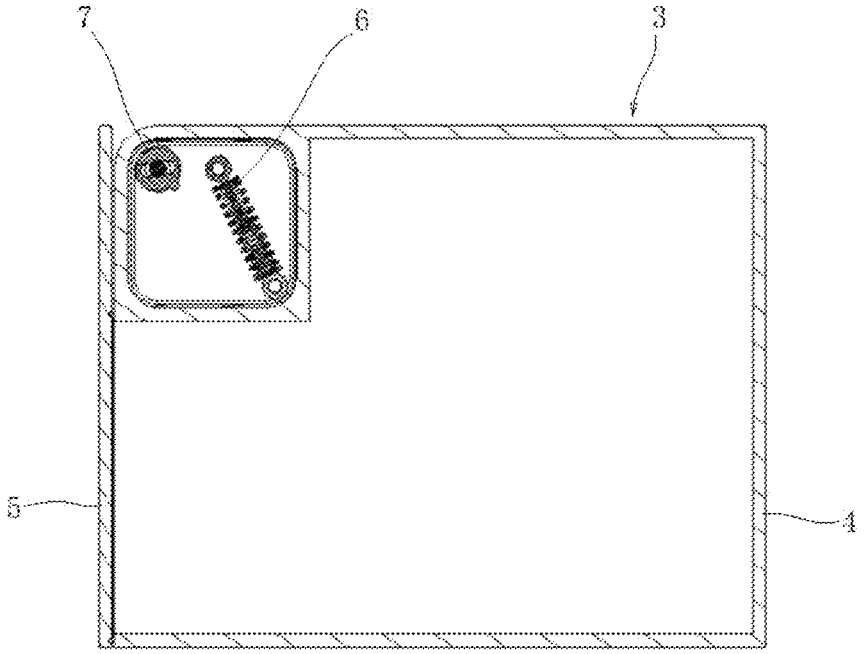
FIG. 4 is a cross-sectional structural diagram of a storage box of some embodiments of the present disclosure in a direction.
Figure 5:
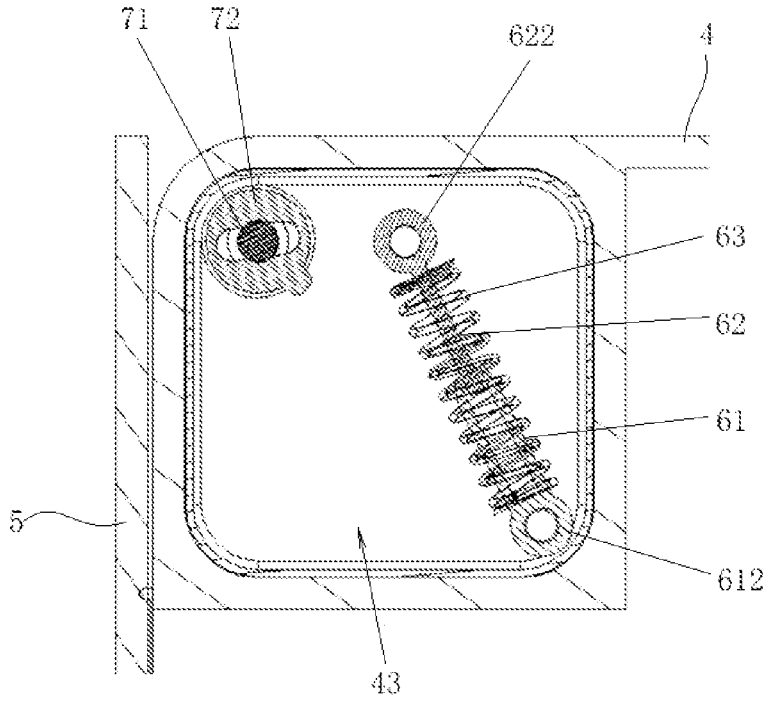
FIG. 5 is a partial enlarged view of a position in FIG. 4.

As shown in FIG. 3, in the storage box 3 of some embodiments, the first telescopic rod includes a sleeve 61 and a movable rod 62. The sleeve 61 includes a sleeve hinge portion and a sleeve hollow portion 611. The sleeve hinge portion is provided at one end of the sleeve 61, and the sleeve hollow portion 611 is provided along an axial direction of the sleeve 61 and has a sleeve opening at the other end of the sleeve 61. As shown in FIG. 3, the sleeve hinge portion is, for example, a sleeve bushing 612. One end of the movable rod 62 extends from the sleeve opening into the sleeve hollow portion 611 and is movable along the axial direction of the sleeve 61, and the other end of the movable rod 62 is provided with a movable rod hinge portion. The sleeve hinge portion and the movable rod hinge portion are respectively located at two ends of the first telescopic rod, and are respectively hinged to the box body 40 and the connecting rod 51. As shown in FIG. 3, the movable rod hinge portion may, for example, be a movable rod bushing 622.

As shown in FIG. 3, in the storage box 3 of some embodiments, the elastic member includes a compression spring 63 sleeved on the first telescopic rod. The compression spring 63 is sleeved on the first telescopic rod, and the position and performance of the compression spring 63 are stable, so that the overall performance of the elastic telescopic mechanism 6 and the first container lid connecting mechanism is stable.

Figure 9:
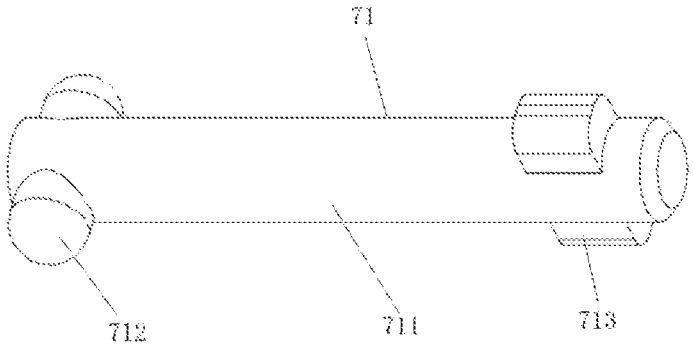
FIG. 9 is a structural diagram of a push rod of a first container lid connecting mechanism of a storage box of embodiments of the present disclosure.
Figure 10:
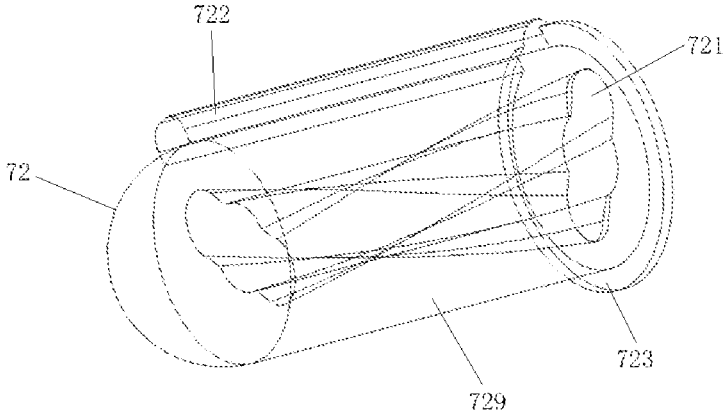
FIG. 10 is a structural diagram of a rotary cap of a first container lid connecting mechanism of a storage box of embodiments of the present disclosure.

In the storage box 3 of some embodiments, the rotating member includes a push rod 71, and the translating member includes a rotary cap 72. One end of the push rod 71 is rotatably connected to the box body 40, and is non-rotationally connected to the connecting rod 51, and the other end of the push rod 71 is provided with a projection 712 disposed in a radial direction of the push rod 71. The rotary cap 72 is sleeved on the end of the push rod 71 provided with the projection 712, and has a helical groove 721 cooperating with the projection 712. In some embodiments, a plurality of projections 712 may be arranged in the radial direction of the push rod 71, and correspondingly, a plurality of helical grooves 721 cooperating with the projections 712 are provided in the rotary cap 72. For example, as shown in FIGS. 3, 9, and 10, two projections 712 spaced 180 degrees apart may be provided on the push rod, and two helical grooves 721 may be provided on the rotary cap 72 correspondingly to the two projections 712.

In the storage box 3 of some embodiments, the push rod 71 is non-rotationally connected to the connecting rod 51 by shape engagement. For example, as shown in FIGS. 3 and 9, the connecting rod 51 is provided with a mounting hole 511 with a keyway, and the push rod 71 is provided with a key 713. A rod body 711 of the push rod 71 passes through the mounting hole 511 with the keyway, and the keyway of the mounting hole 511 cooperates with the key 713. The number of the key 713 may be set as needed, for example two, and the number and position of the keyway correspond to the number and position of the key. As another example, the cross-section shape of a part of the push rod 71 that is connected to the connecting rod 51 and the shape of the mounting hole of the connecting rod 51 are same, each being a non-circular shape, such as a quadrilateral shape, a hexagonal shape, or the like, which may also implement rotation-stop connection by form fit.

In embodiments not illustrated, the push rod and connecting rod may implement non-rotational cooperation by other means. For example, a part of the push rod that cooperates with the connecting rod may be a circular rod segment without a key, and the mounting hole in the connecting rod is correspondingly configured as a circular hole, and the non-rotational connection between the push rod and the connecting rod is implemented by interference fit between the circular rod segment and the circular hole. As another example, the push rod and the connecting rod may also be fixedly connected by other fixed connection means such as welding and riveting.

In the storage box 3 of some embodiments, the first container lid connecting mechanism includes a limiting structure. The limiting structure includes at least one of a first limiting structure, a second limiting structure, and a third limiting structure. The first limiting structure is configured to restrict a limit position of the translating member translating relative to the box body 40. The second limiting structure is configured to restrict rotation of the translating member relative to the box body 40. The third limiting structure is configured to restrict motion of the translating member relative to the box body 40 in a direction perpendicular to a translation direction of the translating member.

Figure 6:
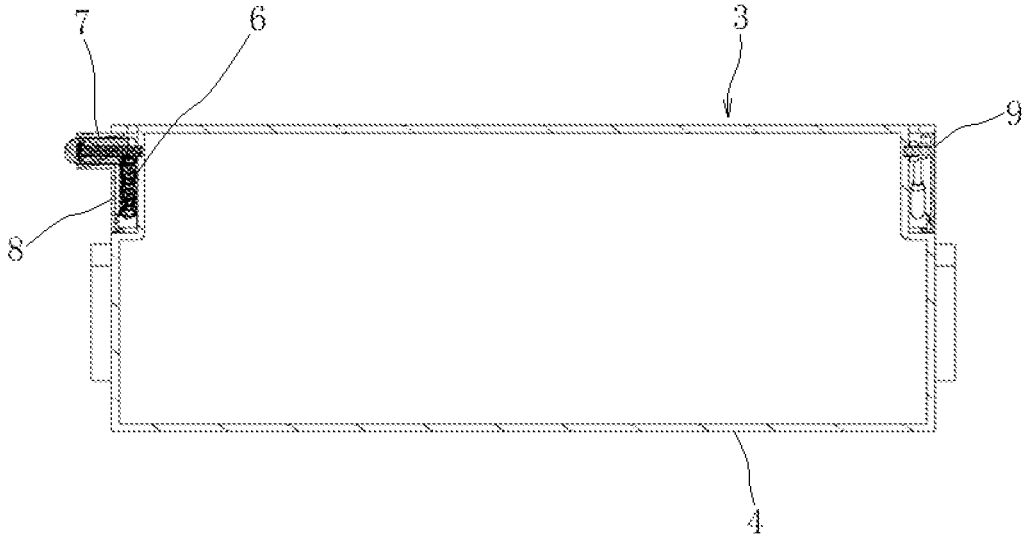
FIG. 6 is a cross-sectional structural diagram of a storage box of embodiments of the present disclosure in another direction.
Figure 7:
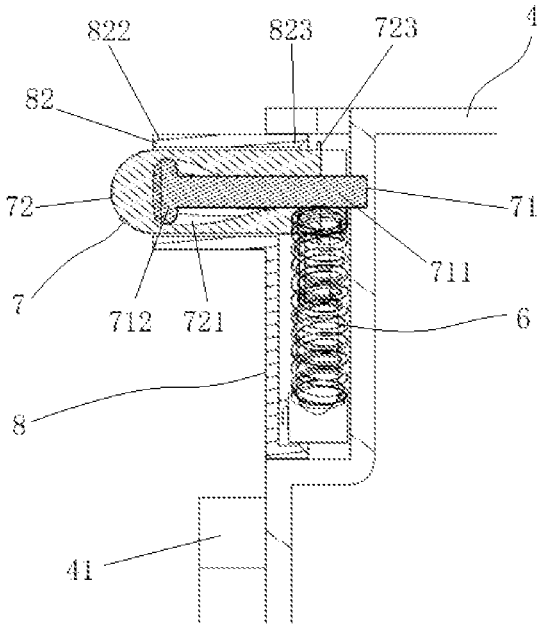
FIG. 7 is a partial enlarged view of a position in FIG. 6.

In the storage box 3 of some embodiments, the first limiting structure includes a first translation limiting surface and a second translation limiting surface. The first translation limiting surface is fixedly disposed relative to the box body 40, with a spacing being formed from the box body 40. The second translation limiting surface is disposed on the translating member, and the second translation limiting surface is located in the spacing between the first translation limiting surface and the box body 40. For example, as shown in FIGS. 3, 6, and 7, the first container lid connecting mechanism includes a first slot cover 8 fixedly disposed on an outer side of the box body 40. The first translation limiting surface includes an end face, on an end close to the box body 40, of a sleeve-like rotary cap hood 82 on the first slot cover main body 80 of the first slot cover 8 projecting from the side of the box body 40 toward a side away from the housing 40, and the second translation limiting surface includes a surface, on a side away from the box body 40, of a radial flange 723 of the rotary cap 72 on an end close to the box body 40.

In some embodiments, the second limiting structure includes a first rotation-limiting portion and a second rotation-limiting portion. The first rotation-limiting portion is fixedly disposed relative to the box body 40, and the second rotation-limiting portion is disposed on the translating member. The first rotation-limiting portion is in form fit with the second rotation-limiting portion to restrict rotation of the translating member with respect to the box body 40. For example, as shown in FIGS. 3, 6, and 7, the first rotation-limiting portion includes a limiting groove formed in an inner wall of a hollow portion of the rotary cap hood 82 of the first slot cover 8. The limiting groove is provided in an axial direction of the rotary cap hood 82. The second rotation-limiting portion includes a projecting strip 722 projecting in a radial direction and extending in an axial direction of the rotary cap 72, provided on a cap body 729 of the rotary cap 72. The projecting strip 722 cooperates with the limiting groove, and may prevent the rotary cap 72 from rotating relative to the box body 40 without hindering movement of the rotary cap 72 along its axial direction.

In the storage box 3 of some embodiments, the third limiting structure includes a limiting hole, and the translating member is located in the limiting hole. The limiting hole has a large end and a small end, and the limiting hole smoothly transits from the large end to the small end along the translation direction of the translating member. The large end is farther from the box body 40 than the small end. This configuration is conducive to maintaining free movement of the translating member in the translation direction while preventing movement of the translating member in a direction perpendicular to the translation direction of the translating member.

For example, as shown in FIGS. 3, 6, and 7, the limiting hole includes a hollow portion of the rotary cap hood 82 of the first slot cover 8, and the limiting hole has a large end at an end 822 of the rotary cap hood 82 away from the box body 40, and a small end at an end 823 of the rotary cap hood 82 close to the box body 40. The translating member includes a rotary cap 72.

In the storage box 3 of some embodiments, the box body 40 is provided with a first accommodating slot 43, and the first container lid connecting mechanism further includes a first slot cover 8. The first slot cover 8 cooperates with the first accommodating slot 43 to form a first accommodating space. The elastic telescopic mechanism 6 is located within the first accommodating space, and at least a portion of the translating member extends out of the first slot cover 8. Since the translating member extends out of the first slot cover 8, the translating member may be operated directly outside the first slot cover 8 to cause a translating action, and the translation of the translating member causes the rotating member to rotate, thereby causing the connecting rod 51 and the lid body 50 fixedly connected to the connecting rod 51 to rotate, and thus the lid body 50 may be manipulated by operating the translating member. For example, in embodiments shown in FIGS. 1 to 15, the translating member includes a rotary cap 72, and the rotating member includes a push rod 71. By translating the rotary cap 72, the push rod 71 rotates by cooperation of a helical groove 721 of the rotary cap 72 and a projection 712 of the push rod 71. Since the push rod 71 is non-rotationally connected to the connecting rod 51, and the connecting rod 51 is fixedly connected to the lid body 50, translating the rotary cap 72 may cause the lid body 50 to rotate.

In the storage box 3 of some embodiments, the container lid 5 includes two connecting rods 51. The two connecting rods 51 are respectively disposed symmetrically at two ends of the container lid 5. The storage box 3 includes two first container lid connecting mechanisms. The two first container lid connecting mechanisms are respectively mounted on two opposite side faces of the box body 40 and are respectively connected to the two connecting rods 51.

In the storage box 3 of some embodiments, the container lid 5 includes two connecting rods 51. The two connecting rods 51 are respectively disposed symmetrically at two ends of the container lid 5. The storage box 3 further includes a second container lid connecting mechanism. The first container lid connecting mechanism and the second container lid connecting mechanism are mounted on two opposite side faces of the box body 40. One of the two connecting rods 51 is connected to the first container lid connecting mechanism, and the other is connected to the second container lid connecting mechanism. The connecting rod 51 connected to the second container lid connecting mechanism is hinged to the box body 40. The second container lid connecting mechanism includes a second telescopic rod. The second telescopic rod and the first telescopic rod are disposed symmetrically. One end of the second telescopic rod is hinged to the corresponding connecting rod 51, and the other end of the second telescopic rod is hinged to the box body 40.

Figure 8:
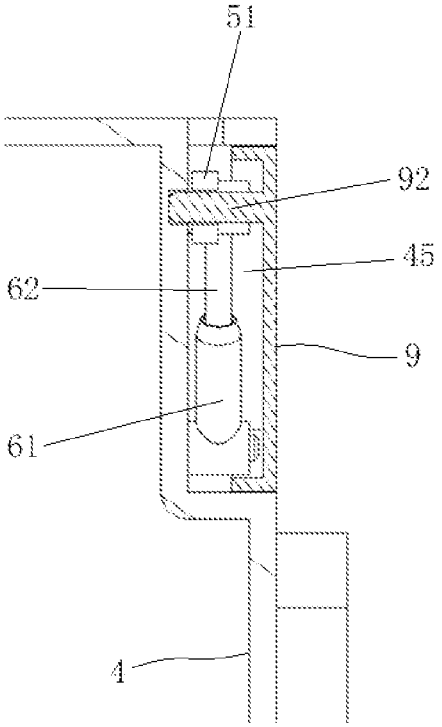
FIG. 8 is a partial enlarged view of another position in FIG. 6.

As shown in FIGS. 7 and 8, in some embodiments, the structure of the second telescopic rod may be configured to be same as the structure of the first telescopic rod, both including a sleeve 61 and a movable rod 62 that is retractable with respect to the sleeve 61, and repeated description is omitted here. To simplify the structure, the second container lid connecting mechanism may dispense with an elastic member and a rotary push mechanism as compared with the first container lid connecting mechanism. Of course, in some embodiments not illustrated, the second container lid connecting mechanism may also include an elastic member to apply to the second telescopic rod a force that tends to lengthen the second telescopic rod.

In the storage box 3 of some embodiments, the box body 40 is provided with a second accommodating slot 45, and the second container lid connecting mechanism further includes a second slot cover 9. The second slot cover 9 cooperates with the second accommodating slot 45 to form a second accommodating space. The second telescopic rod is located within the second accommodating space. In some embodiments, as shown in FIGS. 7 and 8, the second slot cover 9 includes a fixing shaft 92 disposed on the second slot cover body 90 and fixedly connected to the second slot cover body 90. The fixing shaft 92 passes through a circular hole in the connecting rod on a corresponding side so that the connecting rod is hinged to the fixing shaft 92.

In the storage box of some embodiments, the item container 4 further includes a snap-fit structure disposed on the box body 40. The snap-fit structure is configured to fix the storage box 3. For example, as shown in FIGS. 1 to 15, the snap-fit structure includes a buckle 41. The buckle 41 is provided on a side wall of the box body 40 and has an inverted U-shaped clamping slot. A structure connected to the storage box 3, such as the door 2 of the refrigerator, is provided with a lug 211 correspondingly to the buckle 41. When the storage box is connected to the door of the refrigerator, the inverted U-shaped clamping slot on the buckle 41 is directly sleeved on the corresponding lug 211, so that the storage box 3 may be mounted on the door 2.

In the storage box 3 of some embodiments, the storage box 3 further includes a sealing structure. The sealing structure is provided on the box body 40 and/or the lid body 50, and is configured to seal a gap between the lid body 50 and the item container 4 when the lid body 50 closes the box body opening 401. As shown in FIG. 3, the sealing structure includes, for example, a sealing strip 10. The box body 40 and/or the lid body 50 may be provided with a sealing groove for mounting the sealing strip 10. In embodiments shown in FIGS. 1 to 15, a sealing groove 44 is provided on the side of the box body opening 401 of the box body 40, and the sealing strip 10 is mounted in the sealing groove 44 to achieve sealing of the storage box 3 when the lid body 50 completely closes the box body opening 401.

In a refrigerator of embodiments of the present disclosure, as shown in FIGS. 1 and 2, the refrigerator includes a body 1, a door 2, and a storage box 3 mounted on the door 2. The storage box 3 is a storage box 3 of embodiments of the present disclosure.

In the refrigerator of some embodiments, as shown in FIGS. 1 to 15, the storage box 3 is configured such that with closing of the door 2, a translating member of the storage box 3 translates towards a side of getting closer to a box body 40 of the storage box and causes a rotating member to rotate to close a container lid 5.

a refrigerator and its storage box of embodiments of the present disclosure are further described below in conjunction with FIGS. 1 to 15. In the following description, "front" refers to a side where a box body opening 401 of a box body 40 of an item container 4 is located, "rear" refers to a side opposite to the front, "left" and "right" refer to left and right directions when viewed from the front to the rear, and "upper" and "down", or "top" and "bottom" refer to upper and lower or top and bottom after the storage box is mounted to the refrigerator.

The storage box 3 of embodiments of the present disclosure is provided with an elastically movable lid body 50. The lid body 50 may be automatically closed with closing of a door 2 of a refrigerator. The refrigerator includes a body 1, a door 2 and a storage box 3.

The storage box 3 includes an item container 4, a container lid 5, a first container lid connecting mechanism, a second container lid connecting mechanism, and a sealing structure.

The item container 4 includes a box body 40, buckles 41, through slots 42, a first accommodating slot 43, a sealing groove 44, and a second accommodating slot 45. The two buckles 41 are respectively disposed on outer walls of the box body 40 on two opposite sides in a left-right direction. The two through slots 42 are respectively provided on top walls of the box body 40 on the two opposite sides in the left-right direction. As shown in FIGS. 1 to 15, a side of the top wall of the box body 40 close to the box body opening 401 is an arc-shaped wall, and the through slots 42 are formed in the arc-shaped wall, so the through slots 42 are arc-shaped through slots.

The container lid 5 includes a lid body 50, and two connecting rods 51 that are respectively connected to left and right ends of the lid body 50 and extend toward the side of the box body 40. The connecting rod 51 located on a left side is provided with a mounting hole 511 with a keyway and a connecting rod rotating shaft 512 in sequence from the lid body 50. The connecting rod 51 located on a right side is provided with a circular mounting hole and a connecting rod rotating shaft in sequence from the lid body 50.

The first container lid connecting mechanism mainly includes an elastic telescopic mechanism 6, a rotary push mechanism 7 and a first slot cover 8. The first container lid connecting mechanism connects the left-side connecting rod 51 to a left side of the box body 40, thereby connecting the left end of the lid body 50 to the box body 40. The elastic telescopic mechanism 6 includes a first telescopic rod and a compression spring 63. The first telescopic rod includes a sleeve 61 and a movable rod 62.

The second container lid connecting mechanism mainly includes a second telescopic rod and a second slot cover 9. The second container lid connecting mechanism connects the right-side connecting rod 51 to a right side of the box body 40, thereby connecting the right end of the lid body 50 to the box body 40.

The sealing structure includes a sealing strip 10. The sealing strip 10 is mounted in the sealing groove 44 on the box body 40.

As shown in FIGS. 1 and 2, the storage box 3 is placed on a refrigerator door liner 21 of the door 2, and the placement and fixing of the storage box 3 are implemented by cooperation of lugs 211 on the refrigerator door liner 21 and the buckles 41 on the item container 4.

A fixing shaft 431 and a fixing hole 432 are provided in the first accommodating slot 43. A corresponding fixing shaft and fixing hole is provided in the second accommodating slot 45. The first slot cover 8 and the second slot cover 9 are respectively provided with a circle of flange 81 and 91 cooperating with the first accommodating slot 43 and the second accommodating slot. The sealing groove 44 is provided on the side where the box body opening 401 of the box body 40 is located, for placing the sealing strip 10.

The connecting rods 51 respectively extend from left and right sides of the container lid 5, and the connecting rods 51 are inserted into the through slots 42 on the corresponding sides of the item container 4. An inner diameter of a circular hole portion of the mounting hole 511 with the keyway on the left-side connecting rod 51 is same as an inner diameter of the fixing hole 432 and the two holes are concentric, and the mounting hole cooperates with a mechanism cover fixing shaft 92 on a right side of the storage box 3, and cooperates with a push rod body 711 on a left side of the storage box 3.

The movable rod sleeve 61 is provided with a sleeve hollow portion 611 at one end and a sleeve bushing 612 at the other end. The sleeve bushing 612 cooperates with the fixing shaft 431. One end of the movable rod 62 is inserted into the sleeve hollow portion 611, and is capable of telescopic movement in an axis direction of the sleeve hollow portion 611. The other end of the movable rod 62 is provided with a movable rod bushing 622. The movable rod bushing 622 cooperates with the rotating shaft 512 of the left-side connecting rod 51. The compression spring 63 is sleeved around an outer periphery of the first telescopic rod, with one end abutting against an end face of the sleeve bushing 612 and the other end abutting against an end face of the movable rod bushing 622. The compression spring 63 is always in a compressed state due to its large length. The interconnection of the elastic telescopic mechanism 6, the container lid 5 and the item container 4 is implemented by mutual cooperation of holes and shafts of respective parts.

The rotary push mechanism 7 includes a push rod 71 and a rotary cap 72, and functions to convert translational movement of the rotary cap 72 into rotation of the push rod 71, and then convert the latter into rotation of the lid body 50, and to convert rotation of the lid body 50 into rotation of the push rod 71, and then convert the latter into translational movement of the rotary cap 72.

The push rod 71 includes a push rod body 711, two projections 712 provided at a left end of the push rod body 711, and two keys 713 provided at a right end of the push rod body 711. A rotary cap body 729 of the rotary cap 72 is a cap-like structure. A hollow portion of the cap-like structure is provided with a double-ended helical groove 721. An outer side of the rotary cap is provided with a projecting strip 722 projecting in a radial direction and extending in an axial direction, and a right end of the rotary cap is provided with a radial flange 723. The push rod body 711 cooperates with the hollow portion of the rotary cap 72, and the two projections 712 of the push rod 71 cooperate with the double-ended helical groove 721 of the rotary cap 72. The projecting strip 722 of the rotary cap 72 cooperates with a limiting groove, provided in an axial direction of a rotary cap hood 82, in an inner wall of a hollow portion of the rotary cap hood 82 projecting from the first slot cover 8, for preventing the rotary cap 72 from rotating relative to the box body 40. The rotary cap hood 82 is hollow to form a limiting hole. The limiting hole has a large end located at a left end 822 and a small end located at a right end 823, and the diameter of the limiting hole becomes progressively smaller from the large end to the small end. The rotary cap 72 cooperates with the rotary cap hood 82 and is located in the limiting hole, and is movable along the rotary cap hood 82 in a left-right direction. When the rotary cap 72 moves to a maximum stroke, its radial flange 723 is pressed against an end face of the end 823 of the rotary cap hood 82.

The second container lid connecting mechanism is not provided with a compression spring 63 and a rotary push mechanism 7 as compared with the first container lid connecting mechanism. The second container lid connecting mechanism includes a second telescopic rod corresponding to the first telescopic rod. The second telescopic rod has the same structure and is connected to the box body 40 and the second slot cover 9 in the same way. The second slot cover 9 is provided with a fixing shaft 92 as compared with the first slot cover 8. The fixing shaft 92 is rotatably connected to the circular mounting hole (which is concentric with the mounting hole 511 with the keyway on the left side) of the connecting rod 51 located on the right side.

The operating principle of a refrigerator and its storage box of embodiments of the present disclosure are further described below in conjunction with FIGS. 1 to 15.

Figure 11:
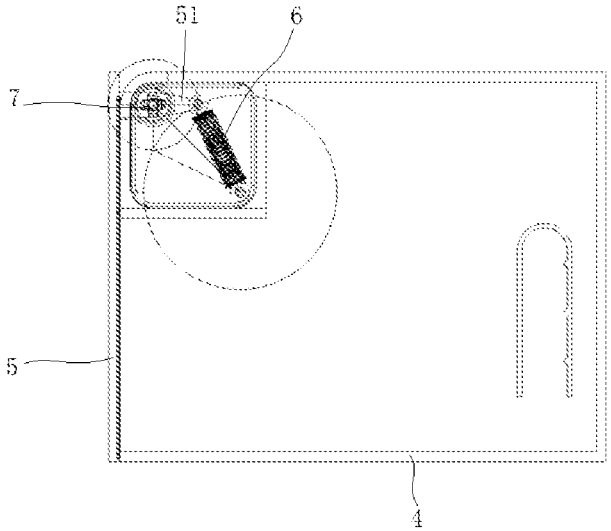
FIG. 11 is a schematic diagram illustrating the operating principle of a first container lid connecting mechanism of a storage box in embodiments of the present disclosure.
Figure 12:
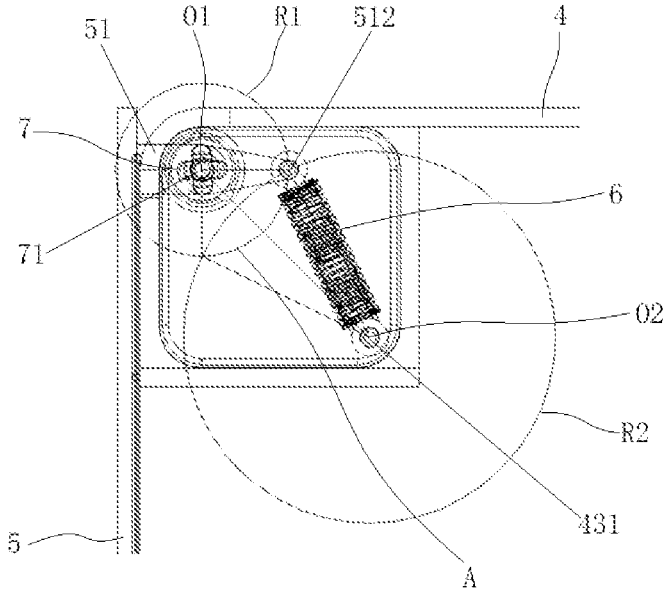
FIG. 12 is a partial enlarged diagram of a position in FIG. 11.

As shown in FIGS. 11 and 12, the movement of the elastic telescopic mechanism 6 is simplified. The circular mounting hole of the right-side connecting rod 51 has the same diameter as the fixing hole in the second accommodating slot and the two holes are concentric, and the circular mounting hole cooperates with the mechanism cover fixing shaft 92 to so that the right-side connecting rod 51 is connected to the item container 4. Axes of the two holes may be denoted as a first fixed axis O1. A first trajectory circle R1 is obtained by rotating around the first fixed axis O1 using a distance between the axis of the mounting hole 511 and an axis of the rotary axis 512 as a radius. An axis of the fixing shaft 431 on the item container 4 may be denoted as a second fixed axis O2, and a second trajectory circle R2 is obtained by rotating around the second fixed axis O2 with a maximum distance between an axis of the sleeve bushing 612 and an axis of the movable rod bushing 622 as a radius. An arc A1 of a part where the first trajectory circle R1 intersects the second trajectory circle R2 is a movement trajectory of the axis of the movable rod bushing 622 of the first telescopic rod.

When a user pokes the container lid 5, an acting force is applied to the container lid 5. The lid body 50 rotates around the fixing shaft 92 under the acting force, causing the connecting rods 51 on the left and right sides to rotate, such that the first telescopic rod and the second telescopic rod respectively cooperating with the two connecting rods 51 both rotate, thereby causing the movable rod 62 to perform retracting movement within the sleeve hollow portion 611 of the sleeve 61. The compression spring 63 is always in a compressed state, and its elastic force is always directed toward the axis of the rotating shaft 512 in the direction of the first telescopic rod 621, and the compression spring provides the first telescopic rod with a force that tends to lengthen the first telescopic rod.

During opening/closing movement of the lid body 50 of the container lid 5, the mounting hole 511 rotates, causing the projection 712 of the push rod 71 of the rotary push mechanism 7 to rotate along the double-ended helical groove 721 of the rotary cap 72, thereby causing the rotary cap 72 to perform extending/retracting movement along the rotary cap hood 82 in a horizontal direction. The stroke of the rotary cap 72 is related to the movement stroke of the lid body 50. The rotary cap 72 makes an extending movement when the lid body 50 is in an opening movement, and the rotary cap 72 makes a retracting movement when the container lid 5 is in a closing movement.

Figure 13:
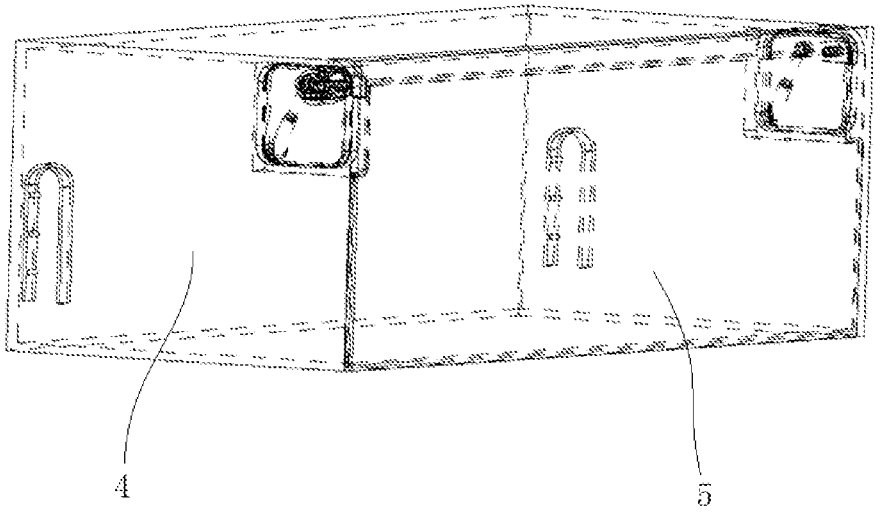
FIG. 13 is a structural diagram of a storage box of embodiments of the present disclosure in a closed state.

As shown in FIG. 13, in an initial state, i.e., when the lid body 50 of the container lid 5 is closed, both the first container lid connecting mechanism and the second container lid connecting mechanism are in a reset state. At that time, the connecting rod 51 is parallel to the plane of the top of the item container 4, and an included angle between the elastic telescopic mechanism 6 and the corresponding connecting rod 51 is in the range of 90°-180°, and an extension amount of the push rod body 711 is minimum. An elastic force of the compression spring 63 is directed towards the axis of the rotating shaft 512 in the direction of the axis of the first telescopic rod, and the force acting there may lock longitudinal freedom of the lid body 50, so that the lid body 50 is closely fit to a front end of the box body 40 of the item container 4 to close the box body opening 401. At the same time, the projection 712 of the push rod 71 of the rotary push mechanism 7 is parallel to the connecting rod 51, and the rotary cap 72 is fully retracted.

Figure 14:
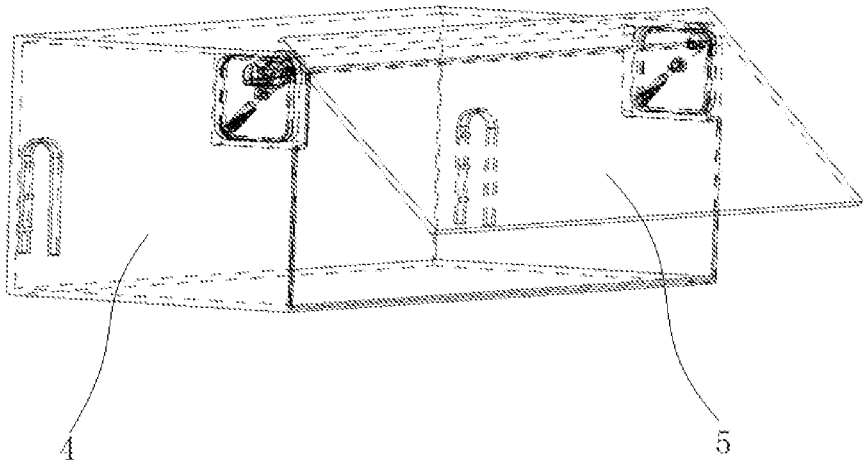
FIG. 14 is a structural diagram of a storage box of embodiments of the present disclosure in a semi-open state.

As shown in FIG. 14, when the lid body 50 of the container lid 5 moves to an optimal flip angle interval, i.e., when an opening angle of the lid body 50 is 20°-30°, the connecting rod 51 and the axis of the first telescopic rod of the elastic telescopic mechanism 6 are at an included angle of 180° and in a straight line, and a retraction amount of the push rod body 711 is maximum. A compression amount of the compression spring 63 is maximum, and a force of the compression spring 63 is perpendicular to the lid body 50 of the container lid 5, so that the lid body 50 may be pushed open to achieve automatic opening in the second half of the stroke of the lid body 50 of the container lid 5. Thus, the flip angle interval of the lid body 50 may be set by adjusting an elasticity coefficient of the compression spring 63.

Figure 15:
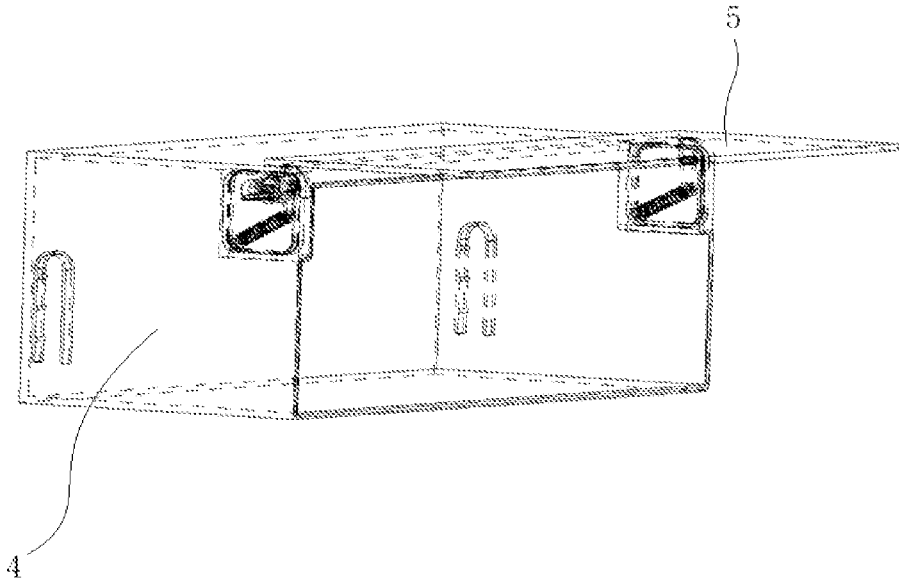
FIG. 15 is a structural diagram of a storage box of embodiments of the present disclosure in a full-open state.

As shown in FIG. 15, when the lid body 50 is opened 90° in place, the elastic telescopic mechanism 6 makes a reverse movement. At that time, the connecting rod 51 is perpendicular to a planar portion of a top wall of the item container 4, and an included angle between the axis of the first telescopic rod of the elastic telescopic mechanism 6 and the connecting rod 51 is in the range of 180°-90°, and an extension amount of the push rod body 711 is maximum. A force of the compression spring 63 is directed towards the axis of the rotating shaft 512 in the direction of the axis of the first telescopic rod, and the elastic force acting there may lock rotational freedom of the lid body 50, thereby maintaining the lid body 50 in an open state. At the same time, the projection 712 of the rotary push mechanism 7 is perpendicular to the connecting rod 51, and the rotary cap 72 is fully extended.

When the rotary cap 72 is fully extended, if the door 2 is closed at that time, the extended rotary cap 72 interferes with the body 1 of the refrigerator, and the rotary cap 72 is pressed and makes a retracting movement, causing the push rod 71 to rotate, thereby causing the connecting rod 51 and the lid body 50 to rotate, thus accomplishing closing of the storage box 3.

According to the above description, the storage box and the refrigerator with the storage box of embodiments of the present disclosure have at least one of the following advantages:

The lid body 50 of the container lid 5 of the storage box 3 is elastically movable. The item container 4 and the container lid 5 of the storage box 3 are connected by a first container lid connecting mechanism. The first container lid connecting mechanism includes an elastic telescopic mechanism 6 and a rotary push mechanism 7. The elastic telescopic mechanism 6 may provide an elastic force for the lid body 50 of the storage box 3 to be kept in a tend-to-be-closed state when being closed, so that the lid body 50 of the container lid 5 is better fit to the box body 40 of the item container 4, and may provide an elastic force for the lid body 50 to open automatically after being opened at a certain angle, so that semiautomatic opening/closing of the storage box 3 may be achieved, and may provide an elastic force that supports the lid body 50 in a completely open position when being fully opened, without artificially supporting the box lid by a user.

By providing the rotary push mechanism 7, when the lid body 50 of the storage box 3 is in the open state, the lid body 50 may be manipulated by operating the translating member.

The storage box 3 is mounted on the door 2 of the refrigerator, and the translating member is located such that when the door 2 is closed, the spacing between the door 2 and the box body 1 gradually becomes smaller, and when the door 2 is closed, the translating member may be pushed by the door 2 to move toward the box body 40, and thus, with the closing of the door 2, the first container lid connecting mechanism is triggered to drive the lid body 50 to close, which takes into account a scenario in which a user forgets to close the container lid after taking/placing an item, and greatly reduces the probability of odor tainting in the refrigerator, enhances the experience of using the refrigerator, and is conducive to improving the quality of the refrigerator.

In the case of using the sealing structure, since the elastic telescopic mechanism 6 may provide an elastic force for the lid body 50 of the storage box 3 to be kept in a tend-to-be-closed state when being closed, so that the lid body 50 is better fit to the item container 4, it can ensure better sealing and higher stability when the lid body 50 of the storage box 3 is closed; for example, in the case the storage box is a refrigerator storage box, items in the storage box are not liable to fall out and not prone to odor tainting with other items in the body 1 of the refrigerator; and there is no need to provide an opening/closing assembly for locking the lid body 50 when being closed, which is favorable for saving costs and improving the universality.

The use of the snap-fit structure facilitates installation and detachment; for example, it may be matched with and applied to refrigerators of many different new and old models, and thus enables wide applications.

Finally, it should be noted that the above embodiments are only used for describing rather than limiting the technical solutions of the present disclosure. Although the present disclosure is described in detail with reference to the preferred embodiments, those of ordinary skill in the art should understand that they still can make modifications to the specific implementations in the present disclosure or make equivalent substitutions to part of technical features thereof; and such modifications and equivalent substitutions should be encompassed within the technical solutions sought for protection in the present disclosure.

The invention claimed is:

1. A storage box, comprising:

an item container, comprising a box body, wherein the box body having a box body opening;

a container lid, comprising a lid body and a connecting rod fixedly connected to the lid body, the connecting rod being hinged to the box body, the lid body being hinged with the box body by the connecting rod, and being configured to open and close the box body opening; and a first container lid connecting mechanism, comprises at least one of an elastic telescopic mechanism or a rotary push mechanism, wherein the elastic telescopic mechanism comprises a first telescopic rod and an elastic member, one end of the first telescopic rod being hinged to the connecting rod, and the other end of the first telescopic rod being hinged to the box body, and the elastic member applying to the first telescopic rod a force that tends to lengthen the first telescopic rod; and the rotary push mechanism comprises a rotating member and a translating member, the rotating member being rotatably connected to the box body, and non-rotationally connected to the connecting rod, a rotation axis of the rotating member being coaxial with a hinge axis of the connecting rod and the box body, and the translating member being disposed outside the box body in a translatable manner with respect to the box body, and being configured to translate by means of rotational movement of the rotating member or to rotate the rotating member by translational movement of the translating member.

2. The storage box according to claim 1, wherein the first telescopic rod comprises:

a sleeve, the sleeve comprises a sleeve hinge portion and a sleeve hollow portion, the sleeve hinge portion being provided at one end of the sleeve, and the sleeve hollow portion being provided along an axial direction of the sleeve and having a sleeve opening at the other end of the sleeve; and a movable rod, one end of the movable rod extending from the sleeve opening into the sleeve hollow portion and being movable along the axial direction of the sleeve, and the other end of the movable rod being provided with a movable rod hinge portion, the sleeve hinge portion and the movable rod hinge portion being respectively located at two ends of the first telescopic rod, and being respectively hinged to the box body and the connecting rod.

3. The storage box according to claim 1, wherein the elastic member comprises a compression spring sleeved on the first telescopic rod.

4. The storage box according to claim 1, wherein the rotating member comprises a push rod, one end of the push rod being rotatably connected to the box body, and being non-rotationally connected to the connecting rod, and the other end of the push rod being provided with a projection disposed in a radial direction of the push rod; and the translating member comprises a rotary cap, the rotary cap is sleeved on the end of the push rod provided with the projection and has a helical groove cooperating with the projection.

5. The storage box according to claim 4, wherein the push rod is non-rotationally connected to the connecting rod by shape engagement.

6. The storage box according to claim 1, wherein the first container lid connecting mechanism comprises a limiting structure, comprising at least one of a first limiting structure, a second limiting structure, or a third limiting structure, wherein the first limiting structure is configured to restrict a limit position of the translating member translating relative to the box body;

the second limiting structure is configured to restrict rotation of the translating member relative to the box body; and the third limiting structure is configured to restrict motion of the translating member relative to the box body in a direction perpendicular to a translation direction of the translating member.

7. The storage box according to claim 1, wherein the first container lid connecting mechanism comprises a limiting structure, comprising at least one of a first limiting structure, a second limiting structure, or a third limiting structure:

wherein the first limiting structure is configured to restrict a limit position of the translating member relative to the box body and comprises a first translation limiting surface and a second translation limiting surface, the first translation limiting surface being fixedly disposed relative to the box body, with a spacing being formed from the box body, the second translation limiting surface being disposed on the translating member, and the second translation limiting surface being located in the spacing between the first translation limiting surface and the box body;

the second limiting structure is configured to restrict rotation of the translating member relative to the box body and comprises a first rotation-limiting portion and a second rotation-limiting portion, the first rotation-limiting portion being fixedly disposed relative to the box body, and the second rotation-limiting portion being disposed on the translating member, the first rotation-limiting portion being in form fit with the second rotation-limiting portion to restrict rotation of the translating member with respect to the box body; and the third limiting structure is configured to restrict motion of the translating member relative to the box body in a direction perpendicular to a translation direction of the translating member and comprises a limiting hole, and the translating member is located in the limiting hole, the limiting hole having a large end and a small end, and the limiting hole smoothly transiting from the large end to the small end along the translation direction of the translating member, the large end being farther from the box body than the small end.

8. The storage box according to claim 1, wherein the box body is provided with a first accommodating slot, and the first container lid connecting mechanism further comprises a first slot cover, the first slot cover cooperating with the first accommodating slot to form a first accommodating space, the elastic telescopic mechanism being located within the first accommodating space, and at least a portion of the translating member extending out of the first slot cover.

9. The storage box according to any one of claim 1, wherein the container lid comprises two connecting rods, the two connecting rods being respectively disposed symmetrically at two ends of the container lid, and the storage box comprises two first container lid connecting mechanisms, the two first container lid connecting mechanisms being respectively mounted on two opposite side faces of the box body and being respectively connected to the two connecting rods.

10. The storage box according to claim 1, wherein the container lid comprises two connecting rods, the two connecting rods being respectively disposed symmetrically at two ends of the container lid, and the storage box further comprises a second container lid connecting mechanism, the first container lid connecting mechanism and the second container lid connecting mechanism being mounted on two opposite side faces of the box body, one of the two connecting rods being connected to the first container lid connecting mechanism, and the other being connected to the second container lid connecting mechanism, the connecting rod connected to the second container lid connecting mechanism being hinged to the box body, the second container lid connecting mechanism comprising a second telescopic rod, the second telescopic rod and the first telescopic rod being disposed symmetrically, one end of the second telescopic rod being hinged to the corresponding connecting rod, and the other end of the second telescopic rod being hinged to the box body.

11. The storage box according to claim 10, wherein the box body is provided with a second accommodating slot, and the second container lid connecting mechanism further comprises a second slot cover, the second slot cover cooperating with the second accommodating slot to form a second accommodating space, the second telescopic rod being located within the second accommodating space.

12. The storage box according to claim 1, wherein the item container further comprises a snap-fit structure disposed on the box body, the snap-fit structure being configured to fix the storage box.

13. The storage box according to claim 1, wherein the storage box further comprises a sealing structure, which is provided on at least one of the box body or the lid body and is configured to seal a gap between the lid body and the item container when the lid body closes the box body opening.

14. A refrigerator, comprising:

a body;

a door; and a storage box, mounted on the door, comprising:

an item container, comprising a box body, wherein the box body having a box body opening;

an container lid, comprising a lid body and a connecting rod fixedly connected to the lid body, the connecting rod being hinged to the box body, the lid body being hinged with the box body by the connecting rod, and being configured to open and close the box body opening; and a first container lid connecting mechanism, comprises at least one of an elastic telescopic mechanism or a rotary push mechanism, wherein the elastic telescopic mechanism comprises a first telescopic rod and an elastic member, one end of the first telescopic rod being hinged to the connecting rod, and the other end of the first telescopic rod being hinged to the box body, and the elasti member applying to the first telescopic rod a force that tends to lengthen the first telescopic rod; and the rotary push mechanism comprises a rotating member and a translating member, the rotating, member being rotatably connected to the box body, and non-rotationally connected to the connecting rod, a rotation axis of the rotating member being coaxial with a hinge axis of the connecting rod and the box body and the translating member being disposed outside the box body in a translatable manner with respect to the box body, and being configured to translate by means of rotational movement of the rotating member or to rotate the rotating member by translational movement of the translating member.

15. The refrigerator according to claim 14, wherein the storage box is configured such that with closing of the door, the translating member of the storage box translates towards a side of getting closer to a box body of the storage box and causes the rotating member to rotate to close a lid body.

* * * * *